US010459391B2

(12) United States Patent
Ishikawa

(10) Patent No.: US 10,459,391 B2
(45) Date of Patent: Oct. 29, 2019

(54) IMAGE FORMING APPARATUS EQUIPPED WITH FUNCTION TO SPECIFY ERROR CAUSING PART

(71) Applicant: CANON KABUSHIKI KAISHA, Tokyo (JP)

(72) Inventor: Naoki Ishikawa, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/000,432

(22) Filed: Jun. 5, 2018

(65) Prior Publication Data

US 2019/0004464 A1 Jan. 3, 2019

(30) Foreign Application Priority Data

Jun. 30, 2017 (JP) ..... 2017-129330

(51) Int. Cl.
*G03G 15/08* (2006.01)
*G03G 15/00* (2006.01)

(52) U.S. Cl.
CPC ..... *G03G 15/55* (2013.01); *G03G 15/0806* (2013.01); *G03G 15/70* (2013.01)

(58) Field of Classification Search
CPC ..... G03G 15/55; G03G 15/0806; G03G 21/1633; G03G 21/1652; G03G 21/1867; G03G 15/70
See application file for complete search history.

(56) References Cited

U.S. PATENT DOCUMENTS 5,613,047 A * 3/1997 Shimomura ..... G03G 15/55 358/1.14

FOREIGN PATENT DOCUMENTS

JP 2008205526 A 9/2008

* cited by examiner

*Primary Examiner* — Hoang X Ngo
(74) *Attorney, Agent, or Firm* — Rossi, Kimms & McDowell LLP

(57) ABSTRACT

An image forming apparatus that is capable of specifying a causal part of an error on the basis of an occurred phenomenon even for a low-skill operator. Causal part candidates are candidates of parts of the apparatus that can cause an error in the apparatus. An associated component is relevant to one of the causal part candidates and a state change thereof is detectable. A detector detects the state change of the associated component. A memory stores the state change of the associated component detected by the detector in association with detected time. A processor executes a function for detecting the error and a function for specifying an error causing part that is the part causing the error from among the causal part candidates based on time at which the error is detected and information stored in the memory.

12 Claims, 13 Drawing Sheets

*FIG. 6*

| ERROR | CAUSAL PART CANDIDATE | ASSOCIATED COMPONENT |
|---|---|---|
| BREAK OF FUSE C | SUBSTRATE D | - |
| | SUBSTRATE E | - |
| | SUBSTRATE F | - |
| | WIRE BUNDLE 31 | - |
| | WIRE BUNDLE 32 | - |
| | WIRE BUNDLE 41 | - |
| | WIRE BUNDLE 42 | MOTOR M51 |
| | S4 | - |
| | S41 | - |

| EVENT | STATUS | TIME |
|---|---|---|
| MOTOR M51 | PRESS CONTACT | 11:05:10 |
| MOTOR M51 | RELEASE | 11:32:11 |
| DETECTION OF BREAK OF FUSE C | ERROR | 11:32:12 |

FIG. 12A

| ERROR | CAUSAL PART CANDIDATE | ASSOCIATED COMPONENT |
|---|---|---|
| BLEAK OF FUSE A | SUBSTRATE A | - |
| | SUBSTRATE C | - |
| | WIRE BUNDLE 11 | - |
| | WIRE BUNDLE 12 | SENSOR S12 |
| | S11 | - |

FIG. 12B

| ERROR | CAUSAL PART CANDIDATE | ASSOCIATED COMPONENT |
|---|---|---|
| BLEAK OF FUSE B | SUBSTRATE A | - |
| | SUBSTRATE B | - |
| | SUBSTRATE C | - |
| | WIRE BUNDLE 21 | - |
| | WIRE BUNDLE 22 | SENSOR S11 |
| | WIRE BUNDLE 31 | - |
| | WIRE BUNDLE 32 | - |
| | S12 | - |
| | S5 | - |

| EVENT | STATUS | TIME |
|---|---|---|
| S11 | L | 10:23:30 |
| S12 | H | 14:05:50 |
| DETECTION OF BREAK OF FUSE A | ERROR | 14:05:51 |

IMAGE FORMING APPARATUS EQUIPPED WITH FUNCTION TO SPECIFY ERROR CAUSING PART

BACKGROUND OF THE INVENTION

Field of the Invention

The present invention relates to an image forming apparatus equipped with a function to specify a causal part of an error within the apparatus.

Description of the Related Art

In general, an image forming apparatus has a plurality of function parts, such as a conveyance unit that conveys a sheet, an image forming unit that forms an image, a transfer unit that transfers the image onto the sheet, and a fixing unit that fixes the transferred image to the sheet. Such an image forming apparatus has a possibility that an error will occur in each of a plurality of function parts.

Moreover, high-productivity and high-performance image forming apparatuses that treat results as products increase in recent years. Increase of the number of parts due to enlargement of such an image forming apparatus for satisfying high specification tends to increase a risk of occurrence of an error.

Downtime resulting from occurrence of an error gives disadvantage to a user who uses an image forming apparatus. Particularly, occurrence of downtime gives great disadvantage to a user who uses a high-productivity and high-performance image forming apparatus. Accordingly, it is needed to restore an image forming apparatus promptly when an error occurs. For example, an image forming apparatus disclosed in Japanese Laid-Open Patent Publication (Kokai) No. 2008-205526 (JP 2008-205526A) stores operation information and action information showing an executed function in the image forming apparatus concerned and specifies a job that caused an error.

However, an operator who works on site needs to presume a causal part of an error even in a case where the job that caused the error is specified on the basis of only the operation information and action information as with the above-mentioned prior art. Accordingly, a low-skill operator needs a considerable period until specifying a causal part of an occurred error, and there is a problem that downtime cannot be reduced.

SUMMARY OF THE INVENTION

The present invention provides an image forming apparatus that is capable of specifying a causal part of an error on the basis of an occurred phenomenon even for a low-skill operator.

Accordingly, a first aspect of the present invention provides an image forming apparatus including causal part candidates that are candidates of parts of the image forming apparatus that can cause an occurrence of an error in the image forming apparatus, an associated component that is relevant to at least one of the causal part candidates and of which a state change is detectable, a detector configured to detect the state change of the associated component, a memory configured to store the state change of the associated component detected by the detector in association with detected time, and at least one processor configured to execute an error detecting function for detecting the occurrence of the error and a function for specifying an error causing part that is the part causing the occurrence of the error from among the causal part candidates based on time at which the occurrence of the error is detected and information stored in the memory.

According to the present invention, since a causal part of an error is specified using action information about the apparatus preceding the occurrence of the error, the period until restoration from an occurrence of the errors is shortened even for a low-skill operator, which reduces the downtime of the image forming apparatus.

Further features of the present invention will become apparent from the following description of exemplary embodiments with reference to the attached drawings.

BRIEF DESCRIPTION OF THE DRAWINGS

FIG. 6 is a view showing an error-causing-part association table used for specifying a causal part of an error when a broken error of a fuse C occurs.

FIG. 12A and FIG. 12B are views respectively showing error-causing-part association tables used for specifying causal parts of errors when a broken error of a fuse A and a broken error of a fuse B in the sensor circuit in FIG. 11 occur.

DESCRIPTION OF THE EMBODIMENTS

Hereafter, embodiments according to the present invention will be described in detail with reference to the drawings.

Figure 1:
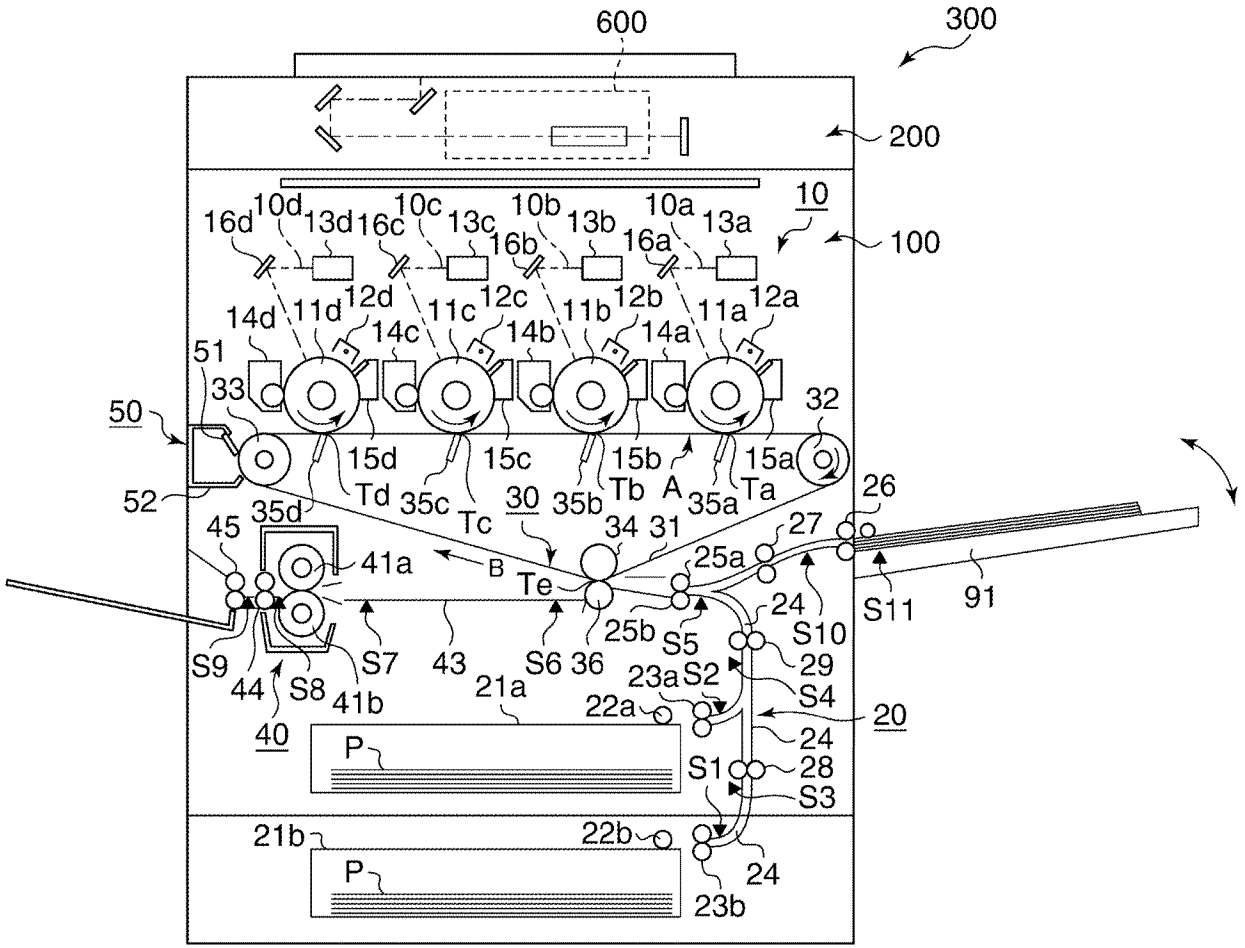
FIG. 1 is a sectional view schematically showing a configuration of an image forming apparatus according to embodiments of the present invention.

FIG. 1 is a sectional view schematically showing a configuration of an image forming apparatus according to an embodiment of the present invention.

As shown in FIG. 1, the image forming apparatus 300 is a color electrophotographic apparatus that employs an intermediate transfer system. The image forming apparatus 300 is provided with an original reader unit 200 that reads an original image, and a printer unit 100 that prints a read image on a sheet (paper sheet). A console unit 600 for operating the image forming apparatus 300 is provided in the front of the original reader unit 200.

The printer unit 100 is provided with an image forming section 10, a sheet feeding unit 20, an intermediate transfer unit 30, and a fixing unit 40.

The image forming section 10 consists of four image forming units 10*a*, 10*b*, 10*c*, and 10*d*. The image forming units 10*a*, 10*b*, 10*c*, and 10*d* have the same configuration. Namely, the image forming units 10*a*, 10*b*, 10*c*, and 10*d* are respectively provided with photosensitive drums 11*a*, 11*b*, 11*c*, and 11*d* as image bearing members. The photosensitive drums 11*a* through 11*d* are supported rotatably in arrow directions in FIG. 1. The photosensitive drums 11*a* through 11*d* are cylindrical photosensitive members for electrophotography.

Charging devices 12*a* through 12*d*, optical systems 13*a* through 13*d*, folding mirrors 16*a* through 16*d*, development devices 14*a* through 14*d*, and cleaning devices 15*a* through 15*d* are arranged along the rotative direction so as to be opposed to outer circumferential surfaces of the photosensitive drums 11*a* through 11*d*.

The charging devices 12*a* through 12*d* give electric charge of uniform charge amount to the surfaces of the photosensitive drums 11*a* through 11*d*. The optical systems 13*a* through 13*d* emit laser beams on the basis of signals modulated corresponding to image signals from the original reader unit 200 and expose the photosensitive drums 11*a* through 11*d* through the folding mirrors 16*a* through 16*d* to form electrostatic latent images. The development devices 14*a* through 14*d* respectively contain developers (hereinafter referred to as "toners") of yellow, cyan, magenta, and black, and develop the electrostatic latent images by applying a development high voltage to developing sleeves to supply the toners to the corresponding photosensitive drums 11*a* through 11*d*.

An intermediate transfer belt 31 that is supported rotatably by a plurality of rollers 32 through 34 is arranged under the photosensitive drums 11*a* through 11*d* of the image forming units 10*a* through 10*d* so that the belt 31 can be slidingly contact with the drums 11*a* through 11*d*. The intermediate transfer belt 31 constitutes the intermediate transfer unit 30. Primarily transfer chargers 35*a* through 35*d* are arranged so as to be respectively opposed to the photosensitive drums 11*a* through 11*d* across the intermediate transfer belt 31, Contact parts between the photosensitive drums 11*a* through 11*d* and the primary transfer chargers 35*a* through 35*d* become primary transfer areas Ta through Td, respectively. The toner images developed on the photosensitive drums 11*a* through 11*d* are transferred onto the intermediate transfer belt 31 at the primary transfer areas Ta through Td by applying the transfer high voltage to the primary transfer chargers 35*a* through 35*d*, respectively, and are superimposed so as to form a color image. The cleaning devices 15*a* through 15*d* clean the surfaces of the photosensitive drums 11*a* through 11*d* by scraping off the toners that remain on the photosensitive drums 11*a* through 11*d* without being transferred to the intermediate transfer belt 31.

A secondary transfer roller 36 is arranged so as to be opposed to the support roller 34 that supports the intermediate transfer belt 31. A contact part between the support roller 34 and the secondary transfer roller 36 becomes a secondary transfer area Te. A cleaning device 50 is arranged at the downstream side of the secondary transfer area Te along the intermediate transfer belt 31 so as to be opposed to the support roller 33. The cleaning device 50 is provided with a cleaning blade 51 for removing toner that remains on the intermediate transfer belt 31 after image transfer, and a recovery toner box 52 that stores recovery toner. The cleaning device 50 cleans the image formation side of the intermediate transfer belt 31.

The sheet feeding unit 20 that supplies a sheet P as a transfer sheet to the secondary transfer area Te is provided with cassettes 21*a* and 21*b* that store the sheet P, and a manual feed tray 91 provided in a side surface of the apparatus body. The manual feed tray 91 is attached to the side surface of the printer unit 10 so as to be capable of opening and closing. The manual feed tray 91 is opened by a user when the user uses the manual feed tray 91. The sheet feeding unit 20 functions as a sheet conveyance device. The sheet feeding unit 20 has a conveyance path 24 along which the sheet P picked up by a pickup roller 22*a* or 22*b*, or a pickup roller pair 26 is transferred to the secondary transfer area Te. Feeding roller pairs 23*a* and 23*b* and vertical-path conveying roller pairs 28 and 29 for conveying the sheet P picked up by the pickup roller 22*a* or 22*b* are provided in a vertical path of the conveyance path 24. In the meantime, a feeding roller pair 27 is provided in a manual feed path along which the sheet P picked up by the pickup roller pair 26 of the manual feed tray 91 is conveyed.

Registration rollers 25*a* and 25*b* are arranged at the downstream side of the merging point of the vertical path and manual feed path of the conveyance path 24. The registration rollers 25*a* and 25*b* send the sheet P to the secondary transfer area Te in accordance with an image formation timing of the image forming unit 10. The fixing unit 40 and a conveyance guide 43 that guides the sheet P to a nip position of the fixing unit 40 are provided in the downstream side of the secondary transfer area Te. The fixing unit 40 is provided with a fixing roller 41*a* that includes a heat source like a halogen heater, and a pressure roller 41*b* that press-contacts to the fixing roller 41*a*. Ejection roller pairs 44 and 45 that eject the sheet P ejected from the fixing unit 40 outside the apparatus are arranged at the downstream side of the fixing unit 40 in the conveyance path.

An upper-cassette feeding sensor S2 and a lower-cassette feeding sensor S1 are respectively arranged at the downstream sides of the feeding roller pairs 23*a* and 23*b* that are respectively provided in the exits of the cassettes 21*a* and 21*b*. Moreover, a second vertical path sensor S3 and a first vertical path sensor S4 are arranged on the vertical path of the conveyance path 24. Moreover, a registration sensor S5 is arranged at the upstream side of the registration rollers 25*a* and 25*b*. A transfer sensor S6 is arranged at the entrance of the conveyance guide 43. Furthermore, a fixing entrance sensor S7 and a fixing exit sensor S8 are respectively arranged at the entrance and exit of the fixing unit 40. An ejection sensor S9 is arranged between the ejection roller pairs 44 and 45. The sensors S1 through S9 detect the sheet P that is conveyed.

Moreover, a manual feed tray sensor S11 is provided in the manual feed tray 91. The manual feed tray sensor S11 detects sheets stacked on the manual feed tray 91. Moreover, a manual feed path sensor S10 is provided in the manual feed path at the downstream of the manual feed tray 91. The manual feed path sensor S10 detects the sheet P that is fed from the manual feed tray 91. Next, a control system of the image forming apparatus 300 in FIG. 1 will be described.

Figure 2:
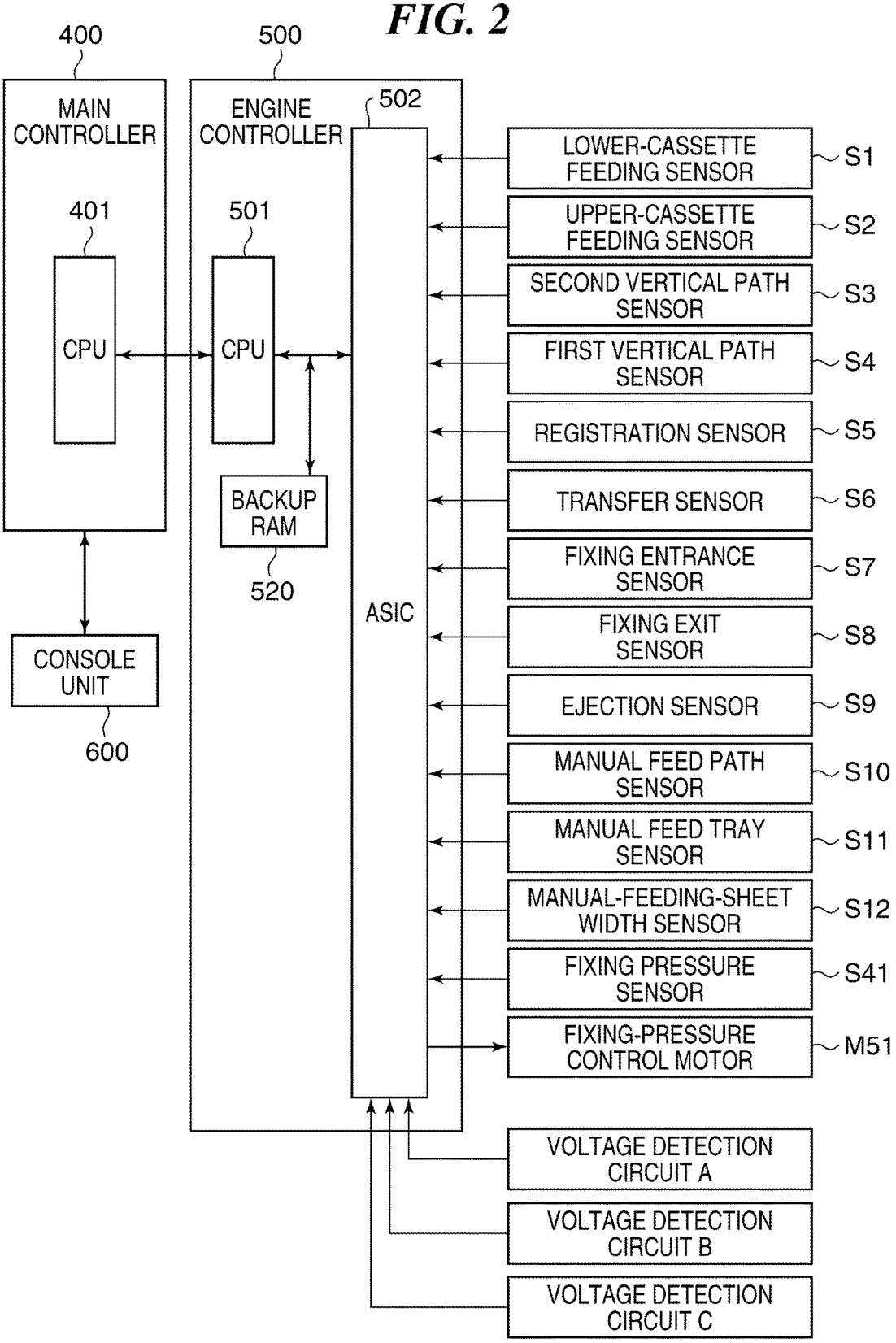
FIG. 2 is a block diagram schematically showing a control system of the image forming apparatus in FIG. 1.

FIG. 2 is a block diagram schematically showing the control system of the image forming apparatus 300 in FIG. 1. As shown in FIG. 2, and the image forming apparatus 300 is provided with a main controller 400 and an engine control unit 500. The main controller 400 includes a CPU 401. The main controller 400 is connected with the console unit 600 through an address bus or a data path.

The engine control unit 500 includes a CPU 501, an ASIC 502, and a backup RAM 520. The CPU 501, ASIC 502, and backup RAM 520 are mutually connected through an address bus or a data path. The CPU 401 in the main controller 400 and the CPU 501 in the engine control unit 500 are connected through an address bus or a data path.

The ASIC 502 of the engine control unit 500 is connected with the lower-cassette feeding sensor S1, the upper-cassette feeding sensor S2, the second vertical path sensor S3, the first vertical path sensor S4, the registration sensor S5, the transfer sensor S6, the fixing entrance sensor S7, the fixing exit sensor S8, the ejection sensor S9, the manual feed path sensor S10, the manual feed tray sensor S11, a manual-feeding-sheet width sensor S12, and a fixing pressure sensor S41 through a sensor I/F circuit (not shown), for example. Moreover, the ASIC 502 is connected to a fixing pressure control motor M51 through a motor driving unit (not shown).

The CPU 501 of the engine control unit 500 executes various commands by controlling devices, such as motors, in the entire apparatus according to programs beforehand stored in a ROM (not shown). Moreover, the CPU 501 communicates with the CPU 401 of the main controller 400 to exchange information required for image formation. The backup RAM 520 has a battery so that stored information can be held even in a state where the power of the image forming apparatus 300 has stopped.

The ASIC 502 generates a control signal to the motor driving unit and executes a calculation process at a high speed by taking in various sensor output signals. The ASIC 502 controls image formation and sheet conveyance by outputting a control signal to the motor driving unit and by detecting a sensor signal.

Next, an operation of the image forming apparatus 300 of such a configuration will be described.

When a signal for starting an image forming operation is emitted, the image forming units 10*a* through 10*d* form electrostatic latent images by irradiating and exposing the photosensitive drums 11*a* through 11*d* with the laser beams emitted from the optical systems 13*a* through 13*d* via the mirrors 16*a* through 16*d*. The electrostatic latent images formed on the photosensitive drums 11*a* through 11*d* are developed by the development devices 14*a* through 14*d* that respectively contain toners of four colors that are yellow, cyan, magenta, and black. That is, since a high voltage for development is applied to developing sleeves of the development devices 14*a* through 14*d*, the development devices 14*a* through 14*d* supply the toners of the respective corresponding colors to the photosensitive drums 11*a* through 11*d*, so that the electrostatic latent images are developed so as to form toner images.

Then, the toner image formed on the photosensitive drum 11*d* at the most upstream side in the rotational direction of the intermediate transfer belt 31 is transferred to the intermediate transfer belt 31 at the primarily transfer area Td by the primary transfer charger 35 to which a high voltage is applied. The toner image transferred to the intermediate transfer belt 31 is conveyed to the following primarily transfer area Tc. The image formation units 10*c* through 10*a* form images subsequently so that the respective image formation timings will delay according to periods during which the toner image is conveyed between the image forming units. Accordingly, the toner images are transferred so as to be superimposed on the previously transferred toner image(s) by the primary transfer chargers 35*c* through 35*a*.

The cleaning devices 15*a*, 15*b*, 15*c*, and 15*d* respectively clean the drum surfaces by scraping off the toners that remain on the photosensitive drums 11*a* through 11*d* without being transferred to the intermediate transfer belt 31 at the downstream sides of the primarily transfer areas Ta, Tb, Tc, and Td, The toner images that are formed, transferred to the intermediate transfer belt 31, and superimposed according to such a process form a color image.

In the meantime, when the signal for starting the image forming operation is emitted, the sheet P is sent out one by one by the pickup roller 22*a* or 22*b* from the cassette 21*a* or 21*b*. The sent-out sheet P is guided along the conveyance path 24 by the feeding roller pair 23 and the vertical-path conveying roller pairs 28 and 29 and is conveyed until the front end of the sheet P runs against the nip position of the registration rollers 25*a* and 25*b* that have stopped and deflection of a predetermined amount is formed. The sheet P fed from the lower cassette 21*b* is detected by the feeding sensor S1, second vertical path sensor S3, and first vertical path sensor S4. The sheet P fed from the upper cassette 21*a* is detected by the feeding sensor S2 and first vertical path sensor S4. Then, the sheet P is detected by the registration sensor S5 arranged at the upstream side of the registration rollers 25*a* and 25*b*.

The registration rollers 25*a* and 25*b* start rotating in accordance with a timing at which the image forming unit 10 starts image formation. The rotation start timing of the registration rollers 25*a* and 25*b* is set up so that the sheet P and the toner image transferred on the intermediate transfer belt 31 may coincide in the secondary transfer area Te.

Just before the sheet P that goes into secondary transfer area Te reaches the intermediate transfer belt 31, a high voltage is applied to the secondary transfer roller 36. The four-color toner image formed on the intermediate transfer belt 31 is transferred to the surface of the sheet P by applying the high voltage to the secondary transfer roller 36.

The sheet P to which the four-color toner image has been transferred is detected by the transfer sensor S6 and the fixing entrance sensor S7 and is guided to the nip position of the fixing unit 40 by a conveying belt (not shown) along the conveyance guide 43. The sheet P guided to the nip position of the fixing unit 40 is heated and pressurized by the fixing roller 41*a* and pressure roller 41*b*. This fixes the toner image to the surface of the sheet P. The sheet P to which the toner image has been fixed is conveyed and ejected outside the apparatus by the ejection roller pairs 44 and 45 after being detected by the fixing exit sensor S8 and the ejection sensor S9. The fixing roller 41*a* and pressure roller 41*b* are configured to apply or release roller nip pressure by a fixing pressure control motor M51 (see FIG. 2). A fixing pressure sensor S41 (see FIG. 2) detects that the roller nip pressure is applied or released.

Next, an error detection process executed by the image forming apparatus 300 in FIG. 1 will be described.

Figure 3:
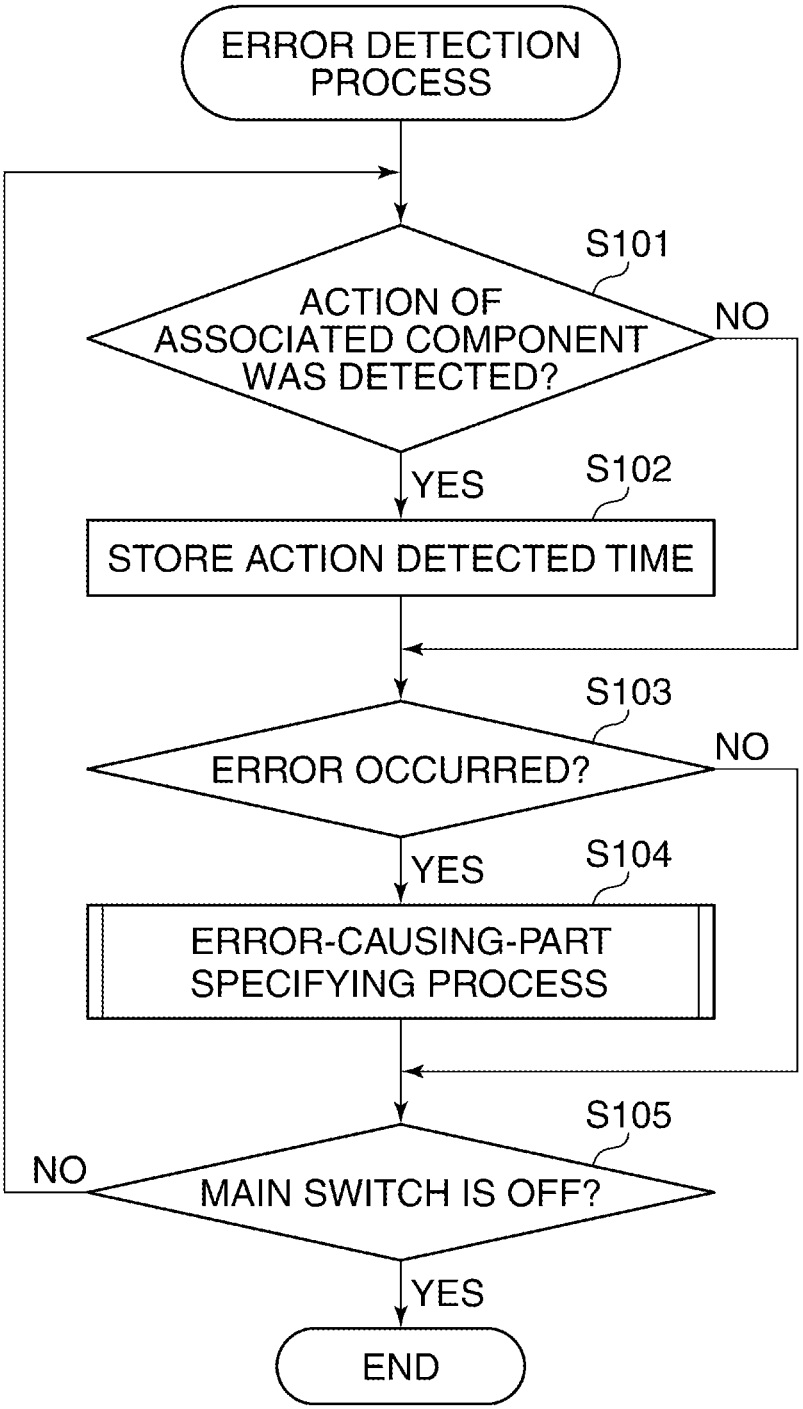
FIG. 3 is a flowchart showing procedures of an error detection process executed by the image forming apparatus in FIG. 1.

FIG. 3 is a flowchart showing procedures of the error detection process executed by the image forming apparatus 300 in FIG. 1. The CPU 501 of the engine control unit 500 in the image forming apparatus 300 executes this error detection process according to an error-detection-process program stored in a ROM (not shown).

As shown in FIG. 3, when the error detection process is started, the CPU 501 first determines whether an action of an associated component that is associated with a part (hereinafter referred to as a causal part candidate) that can cause an error correspond to each of a plurality of error codes was detected (step S101).

In this embodiment, a technique for specifying a causal part (hereinafter referred to as an error causing part) of an error will be described by assuming that the error occurred in relation to the fixing roller 41.

Figure 4:
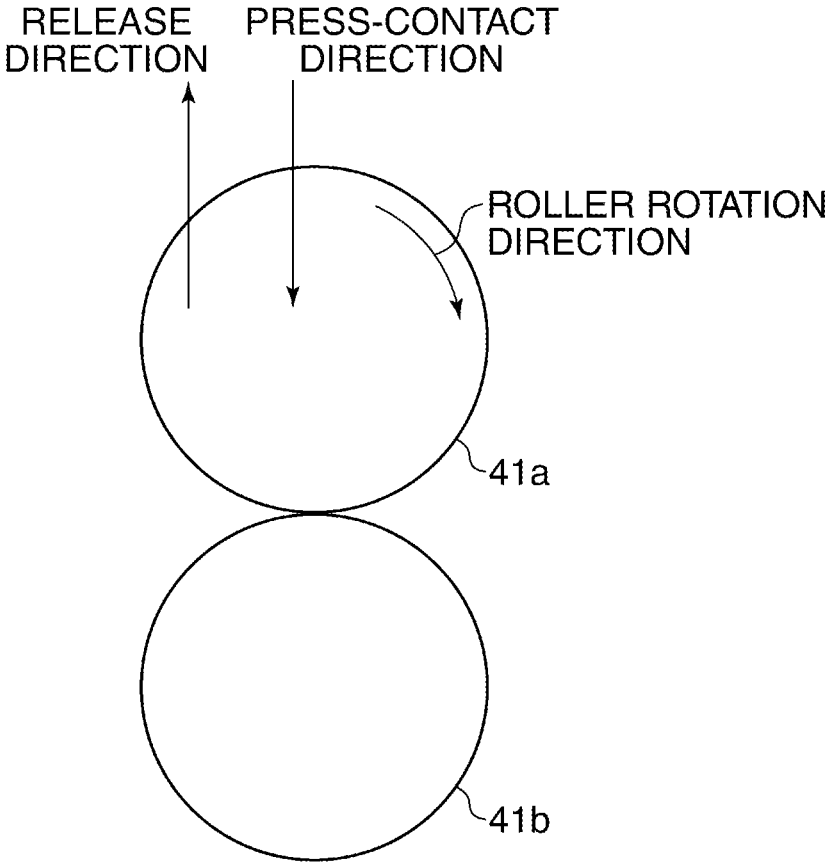
FIG. 4 is a view showing a fixing roller and pressure roller of a fixing device shown in FIG. 1.

FIG. 4 is a sectional view showing the fixing roller 41*a* and pressure roller 41*b* of the fixing unit 40.

As shown in FIG. 4, the roller nip pressure is adjusted by moving the fixing roller 41*a* in a direction abutting to or separating from the pressure roller 41*b*. Releasing of the roller nip pressure prevents the roller's deformation that may occur in a case where the rollers stop for long time while applying the roller nip pressure. Pressure contact and pressure release of the fixing roller 41*a* is performed by the fixing pressure control motor M51 (see FIG. 2). A pressure contact state and a pressure release state of the rollers are detected by the fixing pressure sensor S41 (see FIG. 2).

Figure 5:
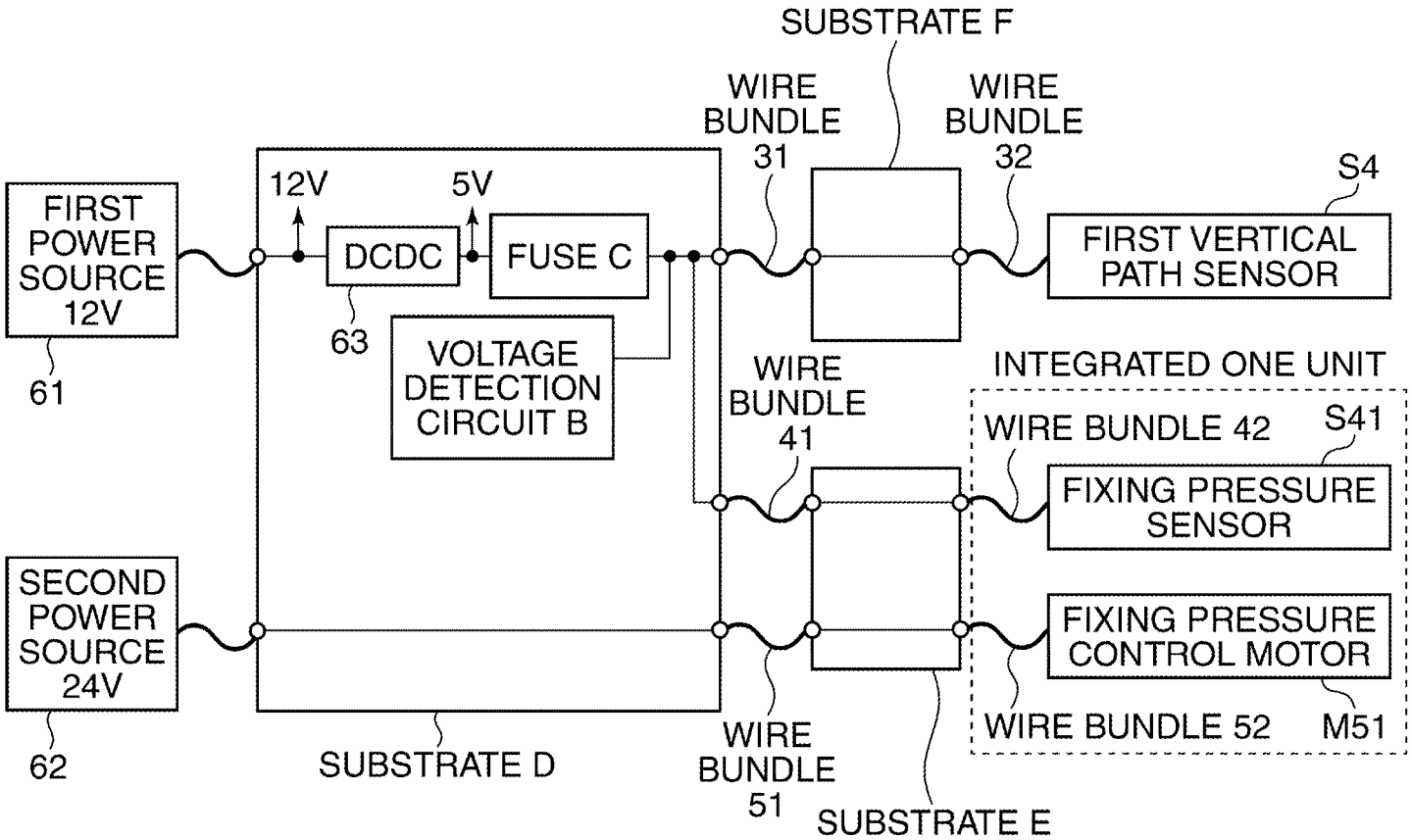
FIG. 5 is a view showing a circuit including a fixing pressure sensor and fixing pressure control motor shown in FIG. 2.

FIG. 5 is a view showing a circuit including the fixing pressure sensor S41 and the fixing pressure control motor M51.

As shown in FIG. 5, a first power source 61 that outputs 12V and a second power source 62 that outputs 24V supply electric power to a substrate D of the image forming apparatus 300. The first power source 61 supplies electric power to a DCDC converter 63 that generates a sensor power source of 5V. The sensor power source of 5V is supplied to the first vertical path sensor S4 through a fuse C and substrate F. Moreover, the sensor power source of 5V is supplied to the fixing pressure sensor S41 through the fuse C and substrate E. That is, the sensor power source of 5V generated by the DCDC converter 63 is supplied to the plurality of sensors. In the meantime, the second power source 62 is connected to the fixing pressure control motor M51 through the substrates D and E.

A wire bundle 31 connects the substrates D and F. Wire bundles 41 and 51 connect the substrates D and E. Moreover, a wire bundle 32 connects the substrate F and the first vertical path sensor S4. A wire bundle 42 connects the substrate E and the fixing pressure sensor S41. A wire bundle 52 connects the substrate E and the fixing pressure control motor M51.

In the substrate D, the fuse C is arranged at the downstream side of the DCDC converter 63, and a voltage detection circuit B is connected to the downstream side of the fuse C. The voltage detection circuit B detects whether the fuse C connected to the 5V line was broken (i.e., whether the power source was cut). For example, a short circuit between the 5V line connected by the wire bundle 42 and a GND line causes overcurrent flow in the 5V line. As a result, the fuse C provided for protection blows out and the voltage of 5V is no longer supplied. At this time, the error of the 5V line is detected because the voltage detection circuit B cannot detect the voltage of 5V. It should be noted that the short circuit between the 5V line and GND line does not occur in a regular wire bundle state. However, an irregular arrangement of a wire bundle (a wire bundle is nipped between metal parts, for example) due to an action of the image forming apparatus may cause the short circuit.

Next, an error-causing-part association table that is used for specifying an error causing part at the time of occurrence of an error will be described.

FIG. 6 is a view showing an error-causing-part association table that is used for specifying an error causing part when a broken error of the fuse C occurs. FIG. 6 lists parts (causal part candidates) that can cause an error relevant to the broken error of the fuse C, and an associated component relevant to a causal part candidate. For example, when the power source of 5V is no longer detected by the voltage detection circuit B in FIG. 5, the engine control unit 500 determines that the broken error of the fuse C occurred. The causal part candidates include the substrates D, E, and F, the wire bundles 31, 32, 41, and 42, the first vertical path sensor S4 and the fixing pressure sensor S41.

Moreover, the causal part candidate and the corresponding associated component are associated with each other. The wire bundle 42 among the causal part candidates mentioned above is connected with the fixing pressure sensor S41 of which a detection value (sensor logic) varies according to the action of the fixing pressure control motor M51. Accordingly, the fixing pressure control motor M51 is associated with the wire bundle 42 as the component relevant to the wire bundle 42 among the components of which actions are detectable. Since an action of a component relevant to a causal part candidate may induce an error at the causal part candidate concerned, the associated component is associated with the causal part candidate.

The power source supplied to the wire bundle 42 that is a causal part candidate is a different system from the power source supplied to the fixing pressure control motor M51 that is an associated part. When a power source of a causal part candidate is a different system from a power source of an associated component, it is easy to specify an error causing part. It should be noted that information in the error-causing-part association table mentioned above shall be beforehand stored in the engine control unit 500.

Referring back to FIG. 3, as a result of the determination in the step S101, when an action of an associated component (the fixing pressure control motor M51, for example) associated with a causal part candidate of an error code was detected ("YES" in the step S101), the CPU 501 stores an action detected time in association with the associated component (step S102). The action of the fixing pressure control motor M51 is detected by the ASIC 502. At this time, when the action detected time has been already stored, the memory information is updated to reflect the last detected time. It should be noted that a plurality of action detected times may be stored so that the oldest detected time will be replaced with the last detected time.

After storing the action detected time of the associated component in the step S102, the CPU 501 determines whether an error occurred (step S103). As a result of the determination in the step S103, an error occurred ("YES" in the step S103), the CPU 501 executes an error-causing-part specifying process to specify a causal part of the error (step S104). The error-causing-part specifying process is mentioned later with reference to FIG. 7.

After executing the error-causing-part specifying process in the step S104, the CPU 501 determines whether a main switch is OFF (step S105). When the main switch is OFF ("YES" in the step S105), this process is finished.

In the meantime, as a result of the determination in the step S105, when the main switch keeps ON ("NO" in the step S105), the CPU 501 returns the process to the step S101 and repeats the process mentioned above. Moreover, as a result of the determination in the step S103, no error has been occurred ("NO" in the step S103), the CPU 501 proceeds with the process to the step S105. Moreover, as a result of the determination in the step S101, when an action of an associated component was not detected ("NO" in the step S101), the CPU 501 proceeds with the process to the step S103 without executing the step S102 and determines whether an error occurred.

According to the process in FIG. 3, when an action of an associated component relevant to a causal part candidate was detected, it is determined whether an error was detected, and an error causing part is specified by executing the error-causing-part specifying process when the error occurred.

Next, the error-causing-part specifying process executed in the step S104 in FIG. 3 will be described.

Figure 7:
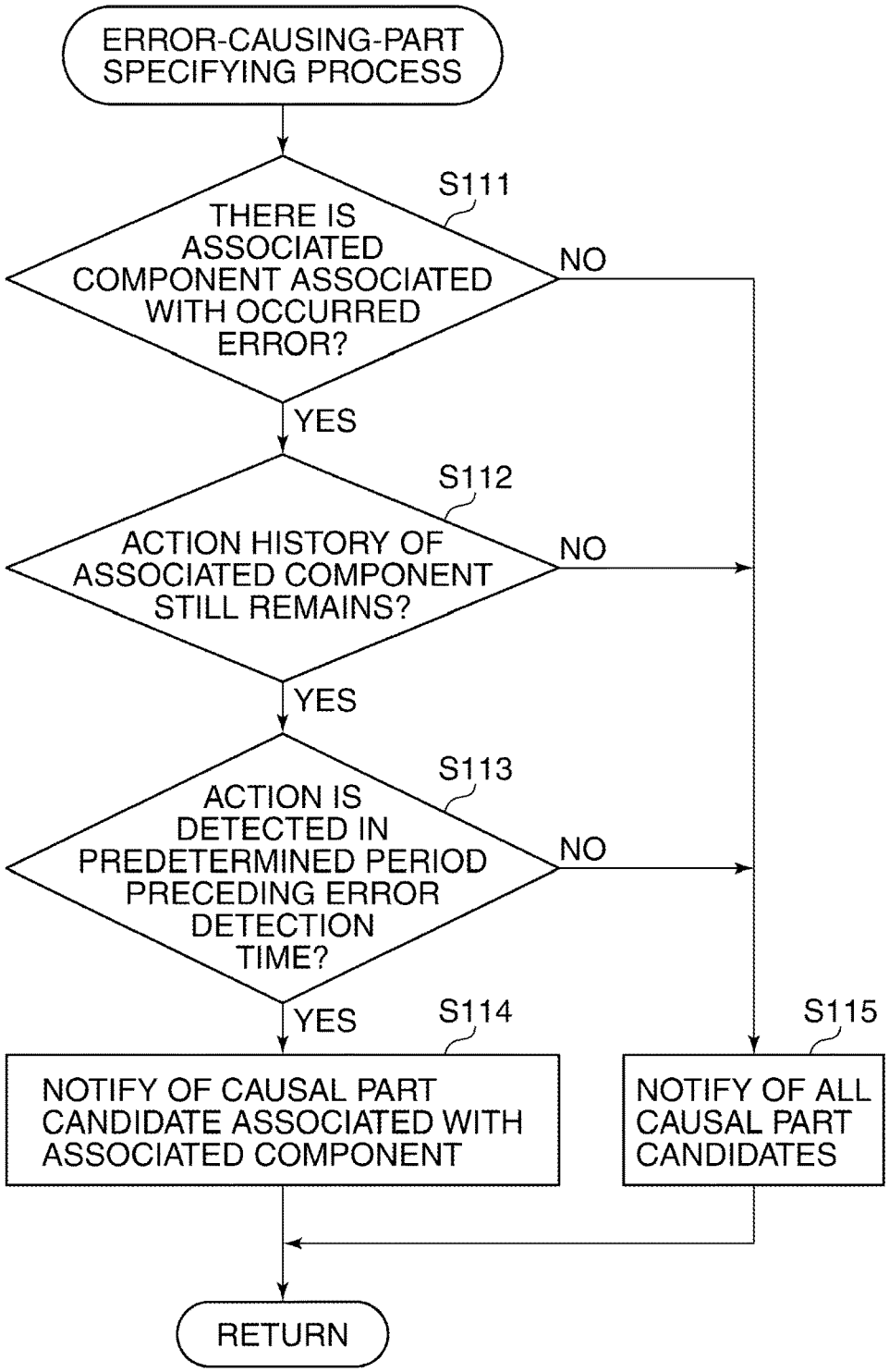
FIG. 7 is a flowchart showing procedures of an error-causing-part specifying process executed in step S104 in FIG. 3.

FIG. 7 is a flowchart showing procedures of the error-causing-part specifying process. The CPU 501 of the engine control unit 500 executes this error-causing-part specifying process according to an error-causing-part specifying program stored in ROM which carried out the (not shown).

As shown in FIG. 7, when the error-causing-part specifying process is started, the CPU 501 first determines whether there is an associated component associated with an occurred error (a broken error of the fuse C, for example) in step S111. According to the above-mentioned error-causing-part association table in FIG. 6, the fixing pressure control motor M51 is associated as the associated component of the wire bundle 42 that is a causal part candidate relevant to the broken error of the fuse C. As a result of the determination in the step S111, when there is an associated component associated with the occurred error ("YES" in the step S111), the CPU 501 determines whether an action history of the associated component (the fixing pressure control motor M51, for example) still remains in the memory information (step S112). That is, the CPU 501 ascertains whether the fixing pressure control motor M51 that is the associated component is activating near the time when the broken error of the fuse C is detected on the basis of action history information.

Figures 8, 9:
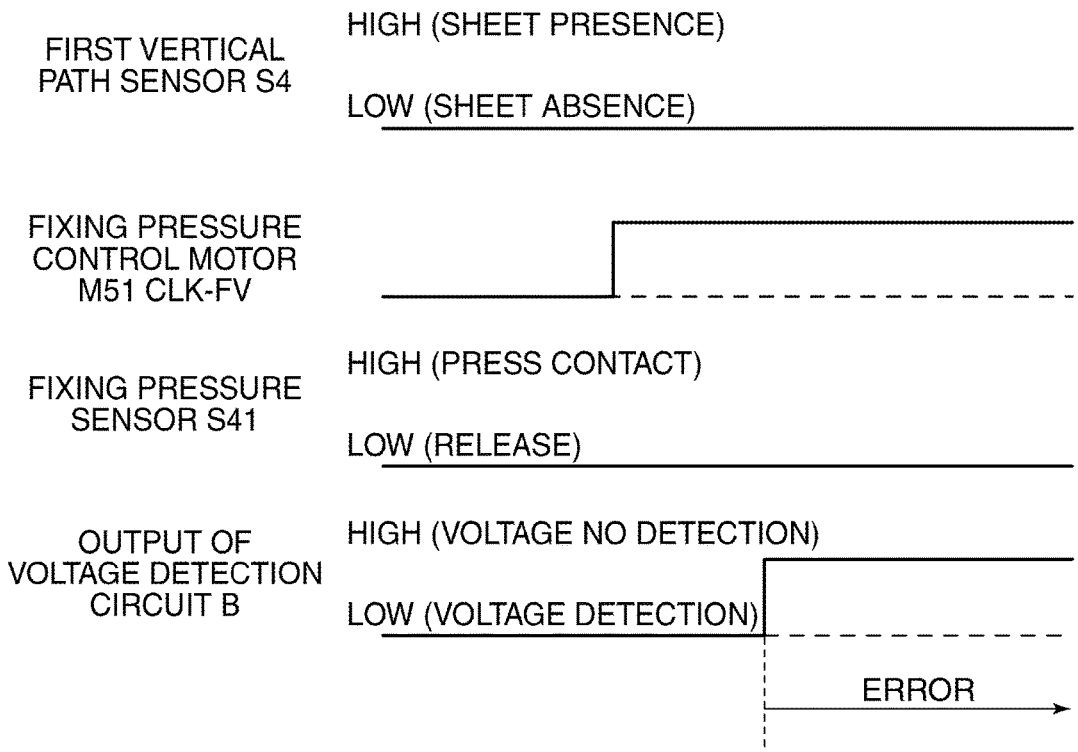
FIG. 8 is a view showing action history information that an engine control unit stores for specifying an error causing part in the circuit shown in FIG. 5.
FIG. 9 is a timing chart showing a case where the fixing pressure control motor shown in FIG. 2 changes an abutting pressure between the fixing roller and pressure roller and where the broken error of the fuse C occurs.

FIG. 8 is a view showing the action history information that the engine control unit 500 stores for specifying an error causing part in the circuit shown in FIG. 5. The action history information includes action time of the component associated with the error as the associated component. As shown in FIG. 8, the action time of the fixing pressure control motor M51 associated with the wire bundle 42 that is a causal part candidate relevant to the broken error of the fuse C is stored as the action history information. Start time of an action in a press-contact direction and start time of an action in the release direction of the fixing pressure control motor M51 are stored. Moreover, the time when the broken error of the fuse C was detected is also stored.

FIG. 9 is a timing chart showing a case where the fixing pressure control motor M51 changes an abutting pressure between the fixing roller 41*a* and pressure roller 41*b* and where the broken error of the fuse C occurs.

As shown in FIG. 9, the output of the voltage detection circuit B becomes no detection after the fixing pressure control motor M51 starts the action in the release direction, which shows the occurrence of the broken error of the fuse C.

The detection time of the error (the broken error of the fuse C, for example) and the action start time of the component (the fixing pressure control motor M51, for example) relevant to the causal part candidate that are stored in this way are available as the information for specifying the error causing part.

Referring back to FIG. 7, as a result of the determination in the step S112, when the action history of the associated component (the fixing pressure control motor M51, for example) still remains as the memory information ("YES" in the step S112), the CPU 501 proceeds with the process to step S113. In the step S113, the CPU 501 determines whether the action time of the fixing pressure control motor M51 is included in a predetermined period preceding the detection time of the broken error of the fuse C. Then, when it is detected that the fixing pressure control motor M51 activated in the predetermined period preceding the error detection time, the CPU 501 specifies the wire bundle 42 to which the fixing pressure control motor M51 is associated as the associated component as the error causing part.

The predetermined period may be set up individually for every associated component. In the first embodiment, the predetermined period used for specifying the error causing part in relation to the action of the fixing pressure control motor M51 is 1.0 second, for example.

As a result of the determination in the step S113, when the action of the fixing pressure control motor M51 is detected in 1.0 second preceding the error detection time ("YES" in the step S113), the CPU 501 proceeds with the process to step S114. In the step S114, the CPU 501 specifies that the wire bundle 42, which is the causal part candidate associated with the fixing pressure control motor M51 as the associated component, is the error causing part, and notifies the main controller 400 of the causal part candidate associated with associated component. When receiving the notification from the CPU 501, the main controller 400 displays that the wire bundle 42 is the error causing part on the console unit 600 and informs an operator. At this time, the associated component associated with the error causing part concerned may be displayed together with the error causing part.

In the meantime, as a result of the determination in the step S111, when there is no associated component associated with the occurred error ("NO" in the step S111), the error causing part cannot be specified. Accordingly, the CPU 501 proceeds with the process to step S115, displays all the causal part candidates (the substrates D, E, and F, the wire bundles 31, 32, 41, and 42, for example) relevant to the detected error on the console unit 600, and notifies the operator (step S115). After that, the CPU 501 finishes this process.

Moreover, as a result of the determination in the step S112, when the operation history of the associated component (the fixing pressure control motor M51, for example) does not remain ("NO" in the step S112), the error causing part cannot be specified. Accordingly, the CPU 501 proceeds with the process to step S115, displays all the causal part candidates relevant to the detected error on the console unit 600 similarly, notifies the operator, and then finishes this process. Furthermore, as a result of the determination in the step S113, when the action of the associated component is not detected in the predetermined period preceding the error detection time ("NO" in the step S113), the CPU 501 cannot specify the error causing part. Accordingly, the CPU 501 proceeds with the process to the step S115, and then finishes this process.

According to the process in FIG. 7, it is determined whether there is an associated component associated with a causal part candidate relevant to an occurred error. When there is an associated component associated, it is determined whether the action history of the associated component still remains in the memory information (step S112). Then, when the action history still remains, it is determined whether an action of the associated component is detected in the predetermined period preceding the error detection time (step S113). When the action is detected in the predetermined period, the causal part candidate associated with the associated component is specified as the error causing part, and it is notified. Since the error causing part is specified using the action information about the apparatus preceding the occurrence of the error, the period until restoration from an occurrence of the error is shortened even for a low-skill operator, which reduces the downtime of the image forming apparatus 300.

In the first embodiment, the case where the broken error of the fuse C occurred is described. Even when another error occurs, an error causing part will be specified similarly on the basis of the action information of the apparatus preceding the occurrence of the error.

Next, a second embodiment of the present invention will be described. In the second embodiment, a method for specifying an error causing part relevant to the manual feed tray 91 will be described.

The manual feed tray sensor S11 for detecting the sheet P stacked on the manual feed tray 91 is provided in the manual feed tray 91. Moreover, manual-feeding-sheet-position regulation plates 92*a* and 92*b* for regulating the position of the sheet P stacked on the manual feed tray 91 in a width direction are provided in the manual feed tray 91.

Figure 10:
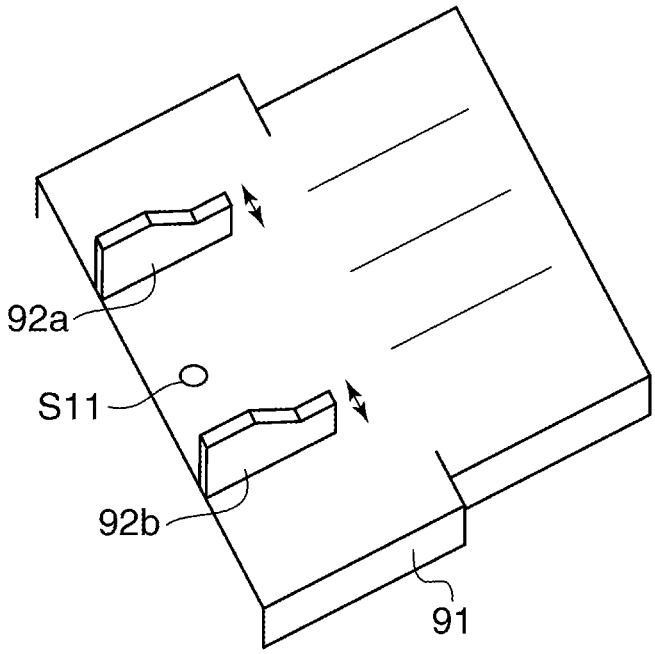
FIG. 10 is a perspective view showing manual-feeding-sheet-position regulation plates provided in a manual feed tray shown in FIG. 1.

FIG. 10 is a perspective view showing the manual-feeding-sheet-position regulation plates 92*a* and 92*b* provided in the manual feed tray 91. As shown in FIG. 10, the manual-feeding-sheet-position regulation plates 92*a* and 92*b* is slidable in a direction of arrows in FIG. 10 according to the width of the sheet. Moreover, the manual feed tray 91 is provided with the manual-feeding-sheet width sensor S12 (see FIG. 2) that detects the width of the sheet by detecting the positions of the manual-feeding-sheet-position regulation plates 92*a* and 92*b*. The manual-feeding-sheet width sensor S12 is a sensor that distinguishes between A4 and A4R of the sheet P, for example. In the meantime, the sensor S12 may detect the width of the sheet as an analog signal using a variable resistance in order to detect the width of the sheet correctly.

Figure 11:
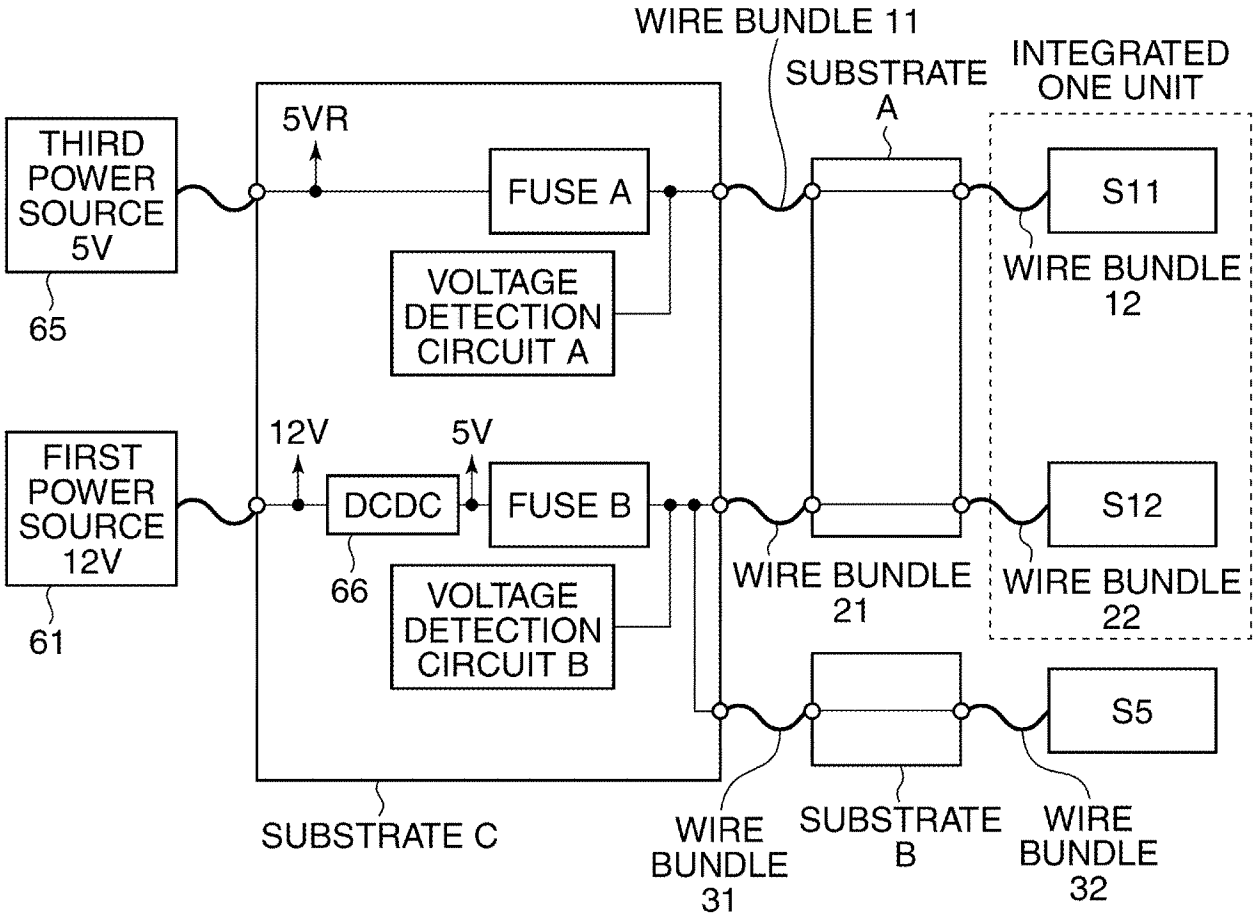
FIG. 11 is a view showing a configuration of a sensor circuit provided in the manual feed tray.

FIG. 11 is a view showing a configuration of a sensor circuit provided in the manual feed tray 91. As shown in FIG. 11, the first power source 61 that outputs 5V and a third power source 65 that outputs 12V supply electric powers to a substrate C of the image forming apparatus according to the second embodiment. The third power source 65 supplies the electric power to the manual feed tray sensor S11 through a fuse A and a substrate A when a plug socket of the image forming apparatus is connected to a commercial power source. A reason why the third power source 65 supplies the electric power to the manual feed tray sensor S11 is for detecting stacking of the sheet P on the manual feed tray 91 even in a case where the apparatus is in a sleep state (power saving mode) and where the electric power is not supplied to a controller relevant to an image forming unit and a conveyance unit. When the stacking of the sheet P on the manual feed tray 91 is detected in the sleep state, the power of the apparatus rises and the apparatus is activated. This shortens a user's latency time.

The electric power of 12V supplied from the first power source 61 is converted into a sensor power source of 5V by a DCDC converter 66. The sensor power source is supplied to the manual-feeding-sheet width sensor S12 through a fuse B and the substrate A and is supplied to the registration sensor S5 through the fuse B and a substrate B.

Wire bundles 11 and 21 connect the substrates C and A. A wire bundle 31 connects the substrates C and B. A wire bundle 12 connects the substrate A and the manual feed tray sensor S11. A wire bundle 22 connects the substrate A and the manual-feeding-sheet width sensor S12. An opening/closing action of the manual feed tray 91 varies postures of the wire bundles 12 and 22. Moreover, a wire bundle 32 connects the substrate B and the registration sensor S5.

A voltage detection circuit A is provided in the substrate C at a downstream side of the fuse A. The voltage detection circuit A detects whether the fuse A connected to the 5V line was broken. Moreover, a voltage detection circuit B is provided at a downstream side of the fuse B. The voltage detection circuit B detects whether the fuse B connected to the 5V line from the DCDC converter 66 was broken.

Next, an error-causing-part association table that is for specifying an error causing part at the time of occurrence of an error will be described.

FIG. 12A and FIG. 12B are views respectively showing error-factor-part association tables used for specifying error causing parts when a broken error of the fuse A and a broken error of the fuse B in the sensor circuit in FIG. 11 occur.

For example, when the voltage detection circuit B in FIG. 11 does not detect the voltage of 5V, the engine control unit 500 determines that the broken error of the fuse A occurred. Causal part candidates relevant to the broken error of the fuse A include the substrates A and C, the wire bundles 11 and 12, and the manual feed tray sensor S11 as shown in the table in FIG. 12A.

An associated component that is capable of detecting an action of a part or a unit near a causal part candidate within the apparatus is associated with the causal part candidate. The wire bundle 12 among the causal part candidates is connected with the manual feed tray sensor S11, and there are the manual-feeding-sheet-position regulation plates 92*a* and 92*b* as action parts near the wire bundle 12. Since the manual-feeding-sheet-position regulation plates 92*a* and 92*b* are needed to be slid according to the width of the sheet, the manual-feeding-sheet width sensor S12 that detects an action near the wire bundle 12 as the causal part candidate is associated with the wire bundle 12 as an associated component (an area surrounded with a broken line in FIG. 11).

Next, the broken error of the fuse B will be described.

For example, when the voltage detection circuit B in FIG. 11 does not detect the voltage of 5V, the engine control unit 500 determines that the broken error of the fuse B occurred. Causal part candidates relevant to the broken error of the fuse B include the substrates A, B, and C, the wire bundles 21, 22, 31, and 32, the manual-feeding-sheet width sensor S12, and the registration sensor S5 as shown in the table in FIG. 12B.

The wire bundle 22 among the causal part candidates is connected with the manual-feeding-sheet width sensor S12, and the manual feed tray sensor S11 detects an action near the wire bundle 22. Since it is assumed that a user operates the manual feed tray 91 when the user stacks the sheet on the manual feed tray 91, the manual feed tray sensor S11 is associated with the wire bundle 22.

Next, the memory information that the engine control unit 500 stores in order to specify an error causing part will be described.

Figures 13, 14:
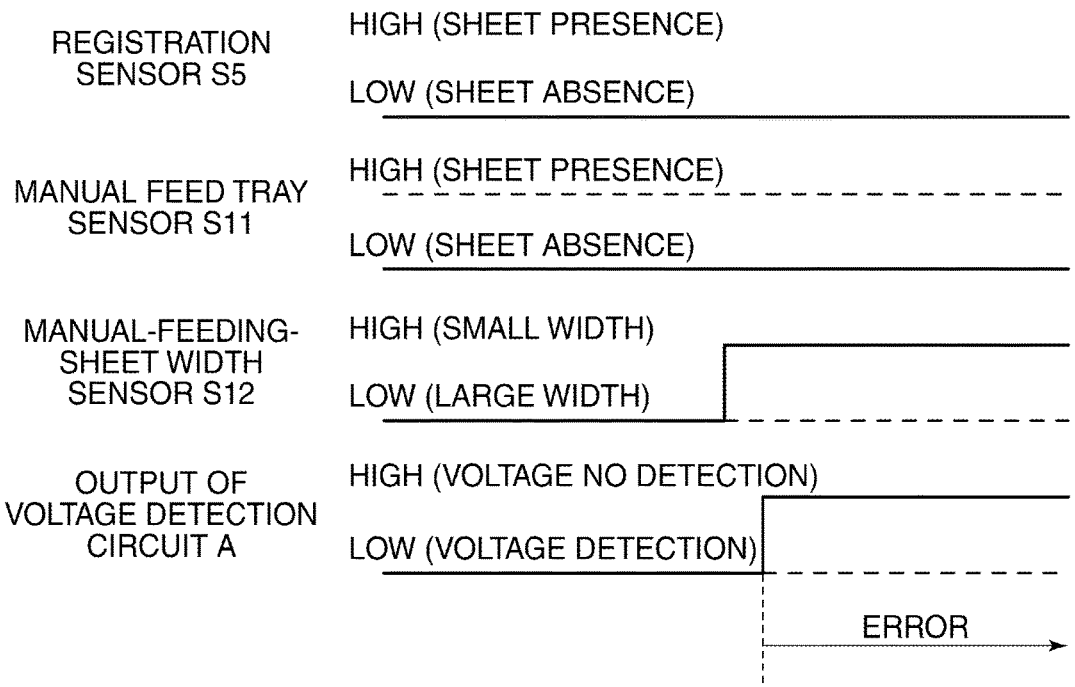
FIG. 13 is a view showing action history information that an engine control unit stores in order to specify an error causing part in the circuit shown in FIG. 11.
FIG. 14 is a timing chart showing a case where the broken error of the fuse A in the sensor circuit in FIG. 11 is detected.

FIG. 13 is a view showing action history information that the engine control unit 500 stores in order to specify an error causing part in the circuit shown in FIG. 11.

The information stored by the engine control unit 500 includes time at which an action of an associated component associated with a causal part candidate, for example. As shown in FIG. 13, the time when the output logic of the manual-feeding-sheet width sensor S12 associated with the wire bundle 12 that is the causal part candidate relevant to the broken error of the fuse A varied is stored in the second embodiment. Similarly, the time when the output logic of the manual feed tray sensor S11 associated with the wire bundle 22 that is a causal part candidate relevant to the broken error of the fuse B varied is stored. Furthermore, the time when the broken error of the fuse A was detected is also stored. The detection time of the error and the action time of the part relative to the error that are stored in this way are available as the information for specifying the error causing part.

Figure 15:
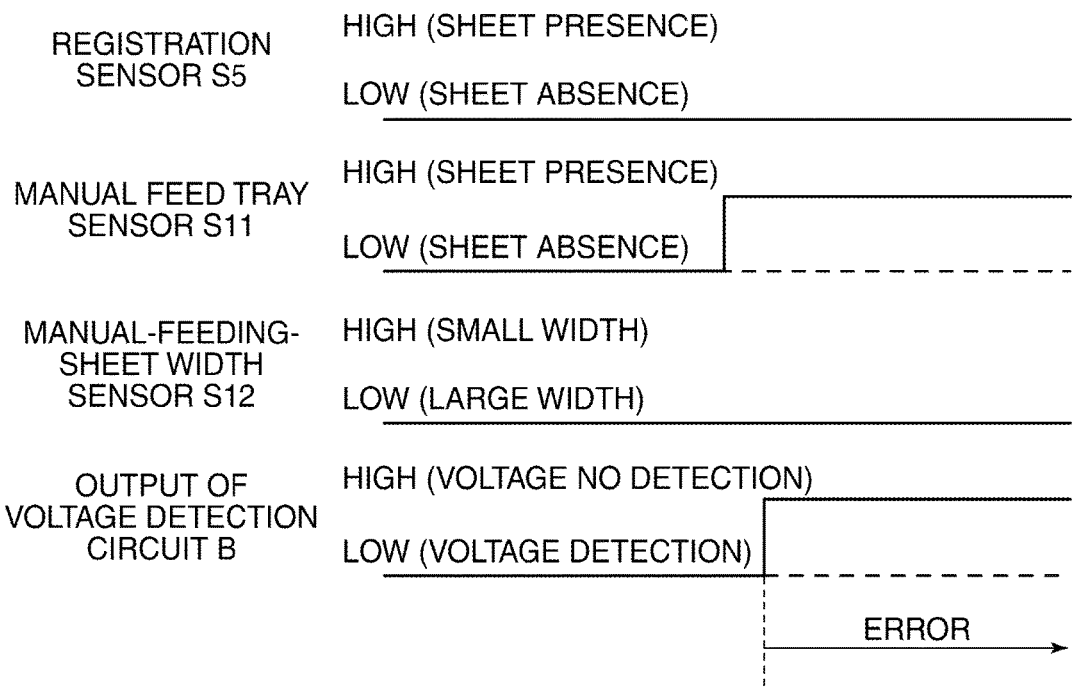
FIG. 15 is a timing chart showing a case where the broken error of the fuse B in the sensor circuit in FIG. 11 is detected.

FIG. 14 is a timing chart showing a case where the broken error of the fuse A is detected. As shown in FIG. 14, the broken error of the fuse A is detected because the voltage detection circuit A stops detecting the voltage of 5V immediately after the output of the manual-feeding-sheet width sensor S12 varies. Moreover, FIG. 15 is a timing chart showing a case where the broken error of the fuse B is detected. As shown in FIG. 15, the broken error of the fuse B is detected because the voltage detection circuit B stops detecting the voltage of 5V immediately after the output of the manual feed tray sensor S11 varies.

The CPU 501 of the engine control unit 500 executes the error detection process (FIG. 3) and the error-causing-part specifying process (FIG. 7) on the basis of the error-causing-part association tables in FIG. 12A and FIG. 12B and the action history information in FIG. 13 as with the first embodiment mentioned above and the error causing part is determined.

When the broken error of the fuse A is detected, it is ascertained whether the output logic of the manual-feeding-sheet width sensor S12 that is the associated component of the wire bundle 12 varied just before the error detection time. In the example shown in FIG. 14, since the output logic of the manual-feeding-sheet width sensor S12 varied just before the voltage detection circuit A detects the error, the wire bundle 12 that is the causal part candidate with which the manual-feeding-sheet width sensor S12 is associated as the associated component is specified as the error causing part. In the table shown in FIG. 13, since the output logic of the manual-feeding-sheet width sensor S12 varied just before the broken error of the fuse A is detected, the wire bundle 12 that is the causal part candidate with which the manual-feeding-sheet width sensor S12 is associated as the associated component is determined as the error causing part.

When the broken error of the fuse B is detected, it is ascertained whether the output logic of the manual feed tray sensor S11 that is the associated component of the wire bundle 22 varied just before the error detection time. In the example shown in FIG. 15, since the output logic of the manual feed tray sensor S11 varied just before the voltage detection circuit B detects the error, the wire bundle 22 that is the causal part candidate with which the manual feed tray sensor S11 is associated as the associated component is determined as the error causing part.

According to the second embodiment, it is determined whether there is an associated component associated with a causal part candidate relevant to an occurred error. When there is an associated component associated, it is determined whether the action history of the associated component still remains. When the action history remains, the error occurrence time is compared with the action time of the associated component. Then, when the action of the associated component is detected in the predetermined period (1.0 second, for example) preceding the error occurrence time, the causal part candidate associated with the associated component is determined as the error causing part. Accordingly, the error causing part is rapidly specified even for a low-skill operator as with the first embodiment mentioned above, which enables the quick restoration and reduces the downtime.

In the second embodiment, the broken errors of the fuses A and B concerning the manual feed tray 91, and the manual feed tray sensor S11 and manual-feeding-sheet width sensor S12 in the manual feed tray 91 were described as examples. However, an error causing part can be determined on the basis of other sensors or parts.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-129330, filed Jun. 30, 2017, which is hereby incorporated by reference herein in its entirety.

What is claimed is:

1. An image forming apparatus comprising:

causal part candidates that are candidates of parts of the image forming apparatus that can cause an occurrence of an error in the image forming apparatus;

an associated component that is relevant to at least one of the causal part candidates and of which a state change is detectable;

a detector configured to detect the state change of the associated component;

a memory configured to store the state change of the associated component detected by the detector in association with a detected time; and at least one processor configured to execute functions as follows:

an error detecting function that detects the occurrence of the error; and a specifying function that specifies an error causing part that is the part causing the occurrence of the error from among the causal part candidates based on a time at which the occurrence of the error is detected and information stored in the memory.

2. The image forming apparatus according to claim 1, wherein the associated component is a motor of which an action changes a state of the at least one of the causal part candidates.

3. The image forming apparatus according to claim 1, wherein the associated component is a sensor that detects a change of a state.

4. The image forming apparatus according to claim 2, wherein one of the causal part candidates is a wire bundle that is connected to the motor for transmitting a signal.

5. The image forming apparatus according to claim 3, wherein one of the causal part candidates is a wire bundle that is connected to the sensor for transmitting a signal.

6. The image forming apparatus according to claim 1, wherein the at least one processor specifies the causal part candidate to which the association component is relevant as the error causing part in a case where the memory stores that the state change of the associated component was detected in a predetermined period preceding the time at which the error was detected by the error detecting function.

7. The image forming apparatus according to claim 1, wherein a power source supplied to the causal part candidate is a different system from a power source supplied to the associated component relevant to the causal part candidate concerned.

8. The image forming apparatus according to claim 7, wherein the power source supplied to the causal part candidate supplies electric power even in a case where the image forming apparatus is in a power saving mode, and the power source supplied to the associated component relevant to the causal part candidate concerned does not supply electric power in the case where the image forming apparatus is in the power saving mode.

9. The image forming apparatus according to claim 1, further comprising a notification unit configured to give notification about information, wherein the at least one processor specifies the error causing part and then controls the notification unit to notify of the specified error causing part.

10. The image forming apparatus according to claim 9, wherein the at least one processor controls the notification unit to notify of the associated component relevant to the specified error causing part in addition to the specified error causing part.

11. The image forming apparatus according to claim 1, wherein the error is cutting of an electric power that should be supplied to the causal part candidate.

12. The image forming apparatus according to claim 1, wherein the causal part candidate is one of a substrate for supplying electric power to the associated component, a wire bundle for supplying the electric power from the substrate to the associated component, and a sensor.

* * * * *